United States Patent [19]

Jow

[11] Patent Number: 5,020,684

[45] Date of Patent: Jun. 4, 1991

[54] FOOD COVER FOR PROVIDING BOTH CLOSED AND FULL OPEN POSITIONS AND INCLUDING SIDE PANELS, AN OFF-SITE MOUNTABLE HINGE AND MIRROR IMAGE FRONT AND BACK PANELS

[76] Inventor: Warren Jow, 5222 Gordon Ave., El Cerrito, Calif. 94530

[21] Appl. No.: 553,709

[22] Filed: Jul. 17, 1990

[51] Int. Cl.[5] ..... B65D 43/02

[52] U.S. Cl. ..... 220/4.24; 220/4.22; 220/335; 312/284; 312/287

[58] Field of Search ..... 312/283, 284, 287; 220/4.22, 4.23, 4.24, 4.25, 335, 85 CH

[56] References Cited

U.S. PATENT DOCUMENTS

| | | | |
|---|---|---|---|
| 972,948 | 10/1910 | Urban | 220/335 |
| 1,080,551 | 12/1913 | Hartwell | 220/335 |
| 1,437,219 | 11/1922 | Berthon | 312/284 |
| 2,479,725 | 8/1949 | Casas-Robert | 312/284 |
| 2,770,389 | 11/1956 | Drakoff | 220/334 |
| 3,098,924 | 7/1963 | Salton et al. | 312/284 |
| 3,420,570 | 1/1969 | Kunz | 220/335 |
| 4,109,790 | 8/1978 | Gottschlich | 220/4.23 |
| 4,167,298 | 9/1979 | Plattner | 312/284 |
| 4,334,629 | 6/1982 | Koch et al. | 220/335 |
| 4,723,693 | 2/1988 | De Coster | 220/335 |

FOREIGN PATENT DOCUMENTS

| | | | |
|---|---|---|---|
| 821955 | 12/1937 | France | 312/284 |

*Primary Examiner*—Stephen Marcus
*Assistant Examiner*—S. Castellano
*Attorney, Agent, or Firm*—Robert Charles Hill

[57] ABSTRACT

A nearly all-plastic food cover is described. It includes a pair of upright side panels resting upon a substantially horizontal base such a table or the like, and a pair of mirror image front and back L-shaped panels.

The side panels each has a pair of oppositely canted, stops molded in its side wall. Each stop is equi-spaced about a working plane normal to both side panels and the horizontal base.

Each L-shaped panel includes an upright, wall segment that rests upon the horizontal base in the closed position of the food cover, and a roof segment that is canted in mirror image fashion about a plastic spider hinge coincident with the working plane. The canted roof segments are designed to be supported upon the canted stops of the side panels in both the full closed and half-open positions of the food cover.

The spider hinge also includes a central spine segment coincident with the pivot axis and a plurality of arms and legs radiating from the spine segment, two of which attach to the lips of the L-shaped panel by means of a series of hand tightened wing nut-bolt combinations. Thus, the invention can be easily assembled and disassembled at an off-site location without tools.

12 Claims, 4 Drawing Sheets

FOOD COVER FOR PROVIDING BOTH CLOSED AND FULL OPEN POSITIONS AND INCLUDING SIDE PANELS, AN OFF-SITE MOUNTABLE HINGE AND MIRROR IMAGE FRONT AND BACK PANELS

FIELD OF THE INVENTION

The present invention relates to food covers. More particularly, it relates to the design, formation and use of such covers in order to provide both a full closed working position and an open position relative to a food tray or the like.

RELATED APPLICATION

In my copending application, Ser. No. 07/467805, filed Jan. 19, 1990 entitled "FOOD COVER FOR PROVIDING BOTH A FULL CLOSED POSITION AND A QUASI-OPEN, SNEEZE GUARD POSITION AND INCLUDING SIDE PANELS, A SEGMENTED HINGE AND MIRROR IMAGE FRONT AND BACK PANELS" and incorporated herein by reference, there is disclosed an embodiment for a food cover that includes a pair of mirror imaged, front and back panels swingable hinged to upright side panels via a central lateral support. In the aforementioned design, the side panels are integrally linked across opposite upper segments to the lateral support.

In many applications, as where the food cover is to be used off site on a temporary basis, such a subassembly can be awkward to transport, especially where other equipment in addition to the food is to be delivered at the same time to the off site location.

BACKGROUND OF THE INVENTION

There has been an increased need to provide efficient food catering services for off-site occasions such as wedding, birthday and garden parties and the like. For such parties, the caterer provides not only the specialty foods, but also all the equipment to serve such foods including food covers, trays, tables, utensils, etc. In transporting such gear to the off-site location, the caterer must carefully stow these items as separate stackable units since available space in his van, truck or the like is limited.

At the off-site locations, the food trays are each provided with separate food covers. One such design I am familiar with uses two domes hinged together by a metal piano hinge across their tops.

The design has several drawbacks. The piano hinge is attached by rivets or the like. Hence once assembled, disassembly of the cover for whatever purpose and re-assembly, is impossible without extensive modification of the design. Hence such covers cannot be easily disassembled and re-assembled at the off site location.

While the prior art is replete with food covers, I am unaware of any design having the following advantages, in combination:

(i) that can be assebled from separate molded plastic elements at the off-site use location without tools;

(ii) after assembly at the off-site location, that can provide protection of food both in a full closed position yet be easily opened to a full open position to serve or to replenish the food;

In this regard, I have reviewed U.S. Pat. Nos. 1,080,551; 2,770,389 and 4,723,693 which show split lid designs for ice chests, frying pans, shakers and the like. These covers have open positions that either are overcenter from any vertical plane through the hinge, or that vary as a function of thickness and type of plastic used to form the hinge. U.S. Pat. Nos. 1,745,548; 3,015,405; 4,005,798; 4,773,555 and RE 32,745 are likewise distinguishable in that for the most part, overcenter open positions attained by mechanical linkages are taught. An exception is U.S. Pat. No. 4,005,798 where the user physically lifts the cover from the pan and uses a slotted metal block attached to the side of the cover to position the cover in an almost vertical position.

SUMMARY OF THE INVENTION

In a preferred form, the present invention includes a pair of upright side panels resting upon a substantially horizontal base such as a table or the like, and a pair of mirror image front and back L-shaped panels.

The side panels each has a pair of oppositely canted, support stops molded in its side wall. Each stop is equispaced about a working plane normal to both side panels and the horizontal base.

Each L-shaped front (or back) panel includes an upright, wall segment having forward (or rearward) edges that rests upon the horizontal base in the closed position of the food cover, and a roof segment that is canted about a plastic spider hinge coincident with the working plane. The roof segments are designed to be oppositely canted about the hinge but match the respective cants of the support stops of the upright side panels. In both the full closed and half-open positions of the food cover, the roof segments are directly supported by the canted support stops of the side panels. That is, since the canted regions of the L-shaped panels are mirror imaged, as one is rotated and the other is stationary, eventually a stable nesting position is established between the two regions. As the canted roof segments nest together one atop the other, support for the new loading relationship shifts from all four support stops of the side panels (when both front and rear L-shaped panels were in the closed position) to one in which both panels are supported by the support stops of the stationary L-shaped panel.

The spider hinge also includes a central spine segment coincident with the pivot axis and a plurality of arms and legs radiating from the spine segment, two of which attach to the roof segment of each L-shaped panel by means of a series of hand tightened wing nut-bolt combinations. Thus, the invention can be easily assembled and disassembled at an off-site location without tools.

The orientation and design of the L-shaped panels (with their complementary roof cants) and the shape of the spider hinge, permit the L-shaped panels to be separately swingable about the working plane coincident with the pivot axis. Yet both L-shaped panels can also be strongly locked in both the full closed and open positions relative to the horizontal base surface.

Assembly at the off-site location includes attaching the spider hinge to the L-shaped panels by inserting the wing nut bolt combinations through aligned openings in the legs of the hinge and in the lips of the roof segments of the L-shaped panels. The wing nuts are then hand tightened. After the front and rear panels are attached, they are placed over the side panels resting on the four support stops. Thus the closed position of the food cover about a tray of food and the like is easily established. To open the food cover, since the panels have opposite cants to their respective roof segments, as one is rotated and the other is stationary, eventually a stable nesting position is established between the two regions. As the canted roof segments nest together one atop the other, support for the new loading relationship shifts from all four support stops of the side panels (when both front and rear L-shaped panels were in the closed position) to one in which both panels are supported by the support stops of the stationary L-shaped panel.

Disassembly is the reverse of the above steps. All disassembly steps, of course, occur without the need for tools.

DETAILED DESCRIPTION OF THE INVENTION

Figure 1:
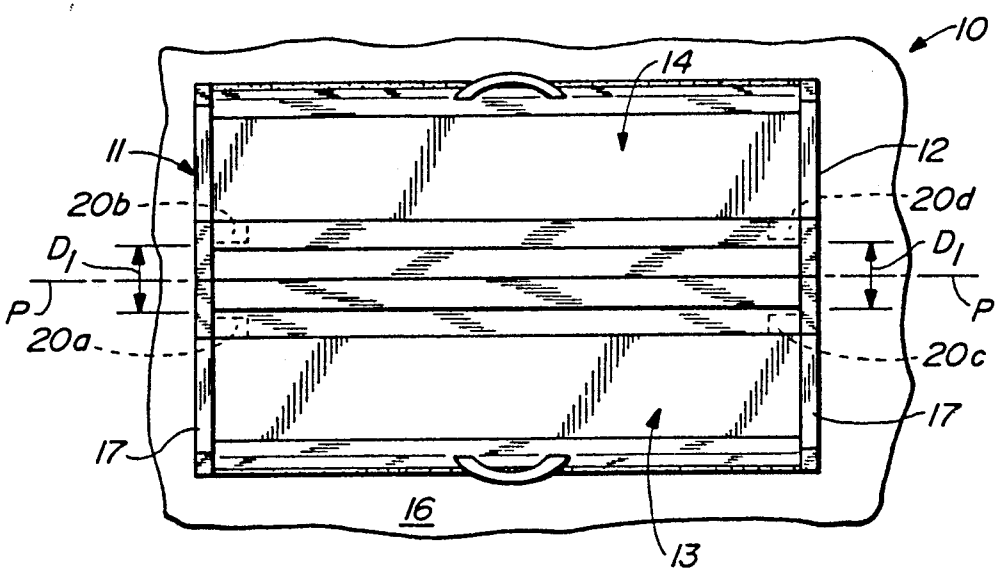
FIG. 1 is a plan view of the food cover of the present invention illustrating a spider hinge, a pair of side panels and front and back L-shaped panels.
Figure 2:
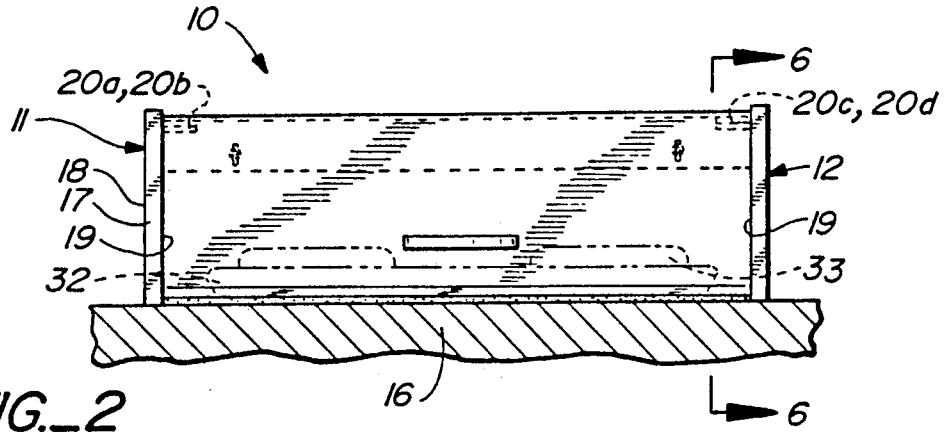
FIGS. 2 and 3 are plan and side views, respectively, of the food cover of FIG. 1.
Figure 3:
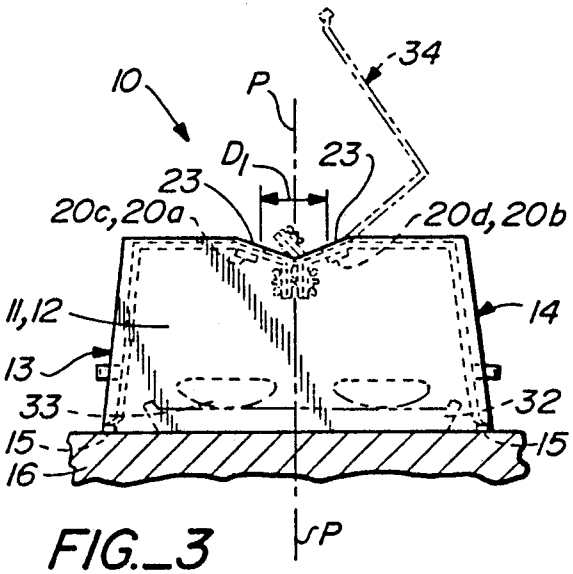

FIG. 1 is a plan view of an food cover 10 of the present invention. The cover 10 includes separately molded, upright side panels 11 and 12, and L-shaped front and back panels 13 and 14. As shown in FIGS. 1, 2 and 3, the cover 10 is in contact with a horizontal base such as table top 16.

The panels 11–14 are preferably formed by first injecting and curing plastics material within a mold. Each panel 11–14 is composed of the following: side panels 11, 12 are duplicates of each other and each includes a side wall 17 terminating in exterior and interior upright surfaces 18, 19 (FIG. 2) and four, separate support stops 20*a*–20*d* extending from the interior surface 19 toward the center of the cover 10. The pairs of stops 20*a*, 20*b* (of side panel 11) and 20*c*, 20*d* (of panel 12) are each separated by a similar distance D1, see FIGS. 1, 3, 4 and 6.

Note also that the matched support stops 20*a*, 20*b* and 20*c*, 20*d* of each upright side panel 11, 12 are oppositely canted with respect to working plane P while lateral pairs of stops (viz., stops 20*a*, 20*c* and 20*b*, 20*c*) are similarly canted. Thus in either closed or open position of the food cover 10, there is sufficient rigidity to assure stability. That is, in closed position, the weight of the front and back panels 13, 14 is distributed the matched support stops 20*a*–20*d* and the bottom edges 15 of the front and back panels 13, 14. However, in the open position for either of the front and back panels 13, 14 the following positioning results: the weight of the opened panel 13 or 14 is distributed between the lateral stop pairs 20*b*, 20*d* or 20*a*, 20*c* and the bottom edges 15 of the stationary panel 13 or 14. That is, in the closed position, front panel 13 rests on lateral pair of support stops 20*a*, 20*c*, while back panel 14 rests on lateral pair 20*b*, 20*d*. Hence, both positions are stable.

As shown in FIGS. 1 and 3, the working plane P is normal to both the base 16 and the upright surfaces 18, 19 of the side panels 11, 12.

Figure 4:
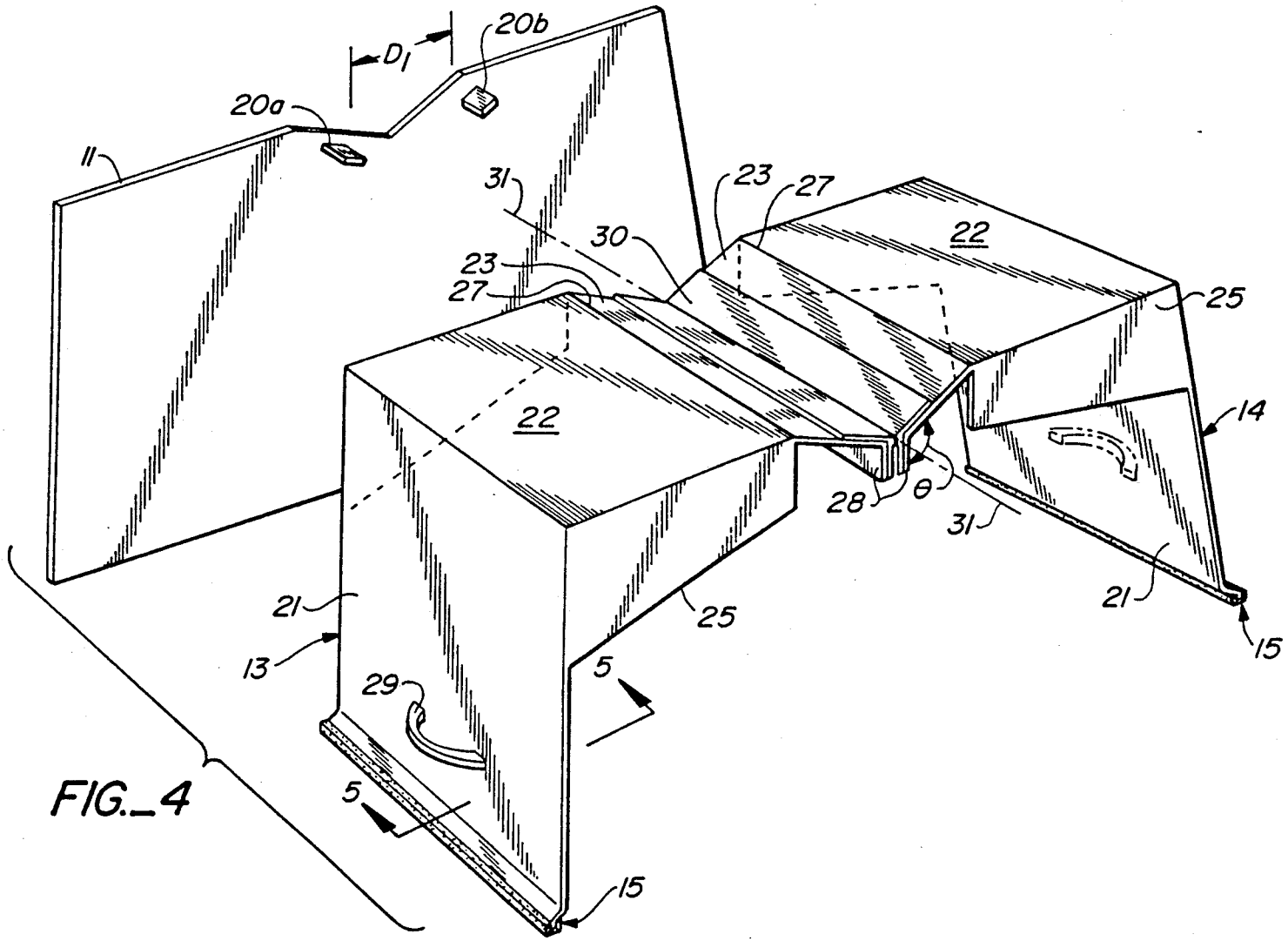
FIG. 4 is an perspective view of the food cover of FIG. 1 partially exploded to illustrate the construction of the side panel in more detail, with the remaining side panels being omitted.

As shown in FIG. 4, the front and back L-shaped panels 13, 14 are each of unitary mirror image design and can be formed also using a mold. Since the panels 13, 14 are mirror images of one another, a description of one suffices for the other.

Each panel 13, 14 comprises an upright segment 21, a horizontal mid-roof segment 22 and a canted end-roof segment 23 terminating in lip 28. Note that canted end-roof segment 23 of front panel 13 rests on the stop 20*a* of side panel 11, while the oppositely canted end-roof segment 23 of the back panel 14 rests on stop 20*b* of the same panel 11. Between the upper end of upright segment 21 and roof segments 22 and 23 is a pair of triangularly shaped ribs 25 associated with each panel 13 or 14. The ribs 25 strengthen the panels 13, 14 and prevent wobble as the panels 13 or 14 are pivoted by means of spider hinge 30 in the manner explained below. A single axis of rotation for the panels 13, 14 is shown at 31.

Figure 5:
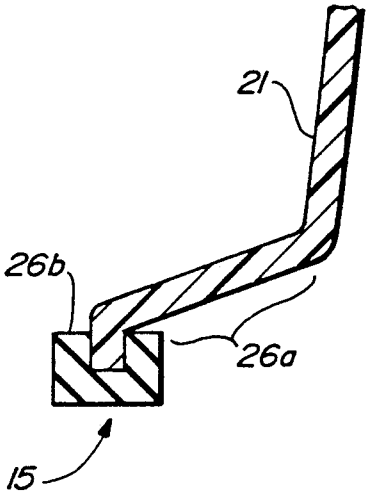
FIG. 5 is enlarged detail of one of the L-shaped panels of FIG. 4.

As shown in FIG. 5, at the bottom end of the upright segment 21 of each panel 13 or 14, is formed terminating edge 15 previously mentioned. It is slightly flared over region 26*a* and includes a rubber bumper 26*b*.

Returning to FIG. 4, the mid- and end-roof segments 22, 23 are seen to meet at 27. While the intersection of the end-roof segment 23 with the lip 28 forms an angle $\theta$. A handle 29 is attached to the vertical segment 21 of each panel 13, 14 as by screws, not shown.

Figure 6:
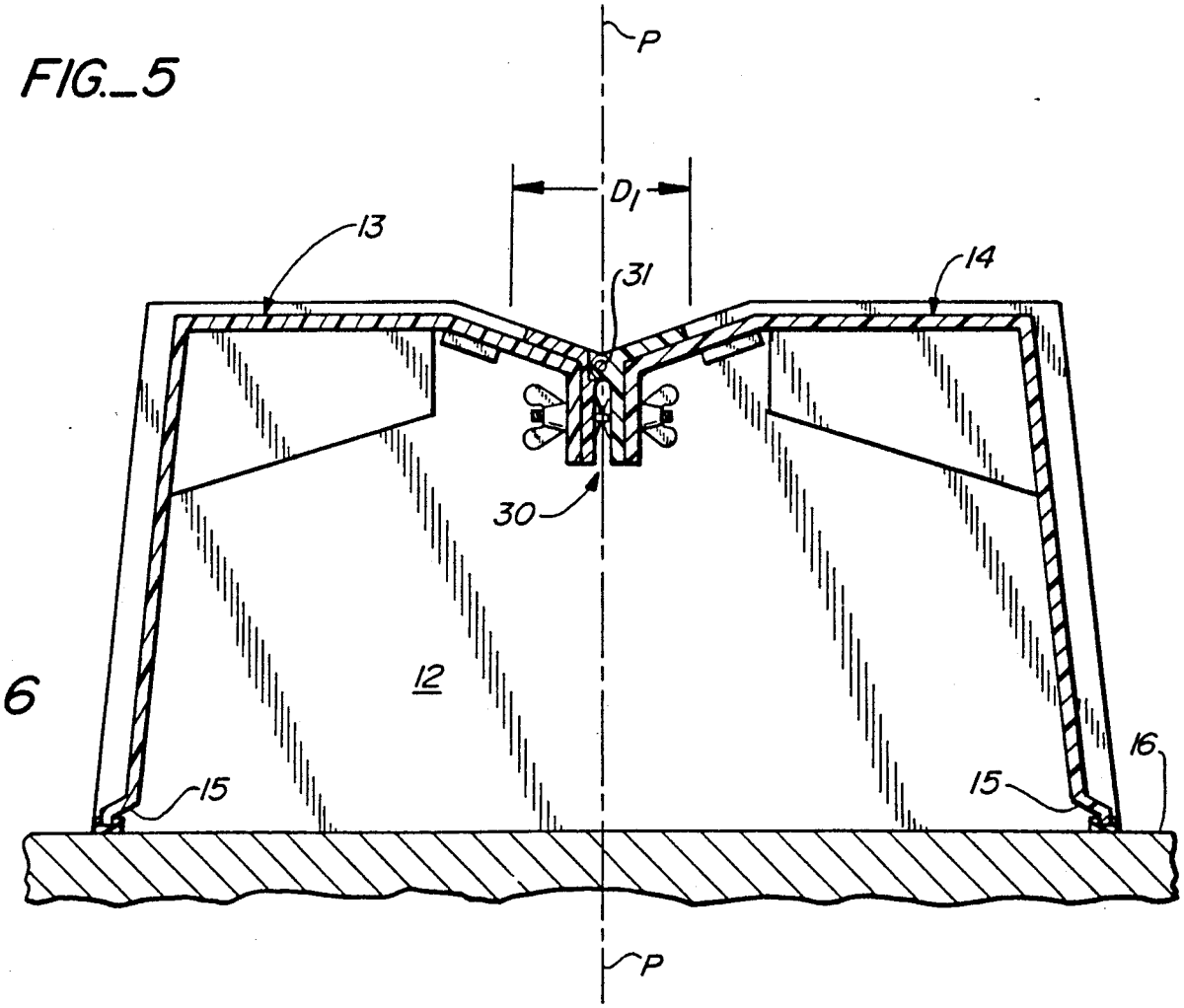
FIG. 6 is a section taken along line 6–6 of FIG. 2.

FIGS. 3 and 6 illustrate that the front and back panels 13, 14 are swingable relative to the side panel 12 via spider hinge 30 in the manner explained below. A singe axis of rotation is shown at 31 of the hinge 30 coincident with the working plane P.

Pivot action occurs by swinging the panels 13, 14 upwardly from the table top 16 about axis of rotation 31. As shown in FIG. 3, the panels 13, 14 protect flat food tray 32 and pastries 33 shown in phantom line.

In FIG. 3, the two operating positions of the panels 13, 14 are shown. The closed position is more clearly shown in solid line. The open position is shown in phantom line at numeral 34. In both the full closed and open positions of the food cover 10, the front and back panels 13, 14 are directly supported by the canted support stops 20*a*–20*d* of the side panels 11, 12. That is, since the L-shaped panels 13, 14 are mirror imaged, as one is rotated and the other is stationary, eventually a stable nesting position is established between the two regions. As the canted roof segments nest together one atop the other, support for the new loading relationship shifts from all four support stops 20*a*–20*d* (when both front and rear L-shaped panels 13, 14 were in the closed position) to one in which both panels 13, 14 are supported by the support stops of the stationary L-shaped panel, viz., support stops 20*b*, 20*d* of back panel 14 in FIG. 3.

Figure 7:
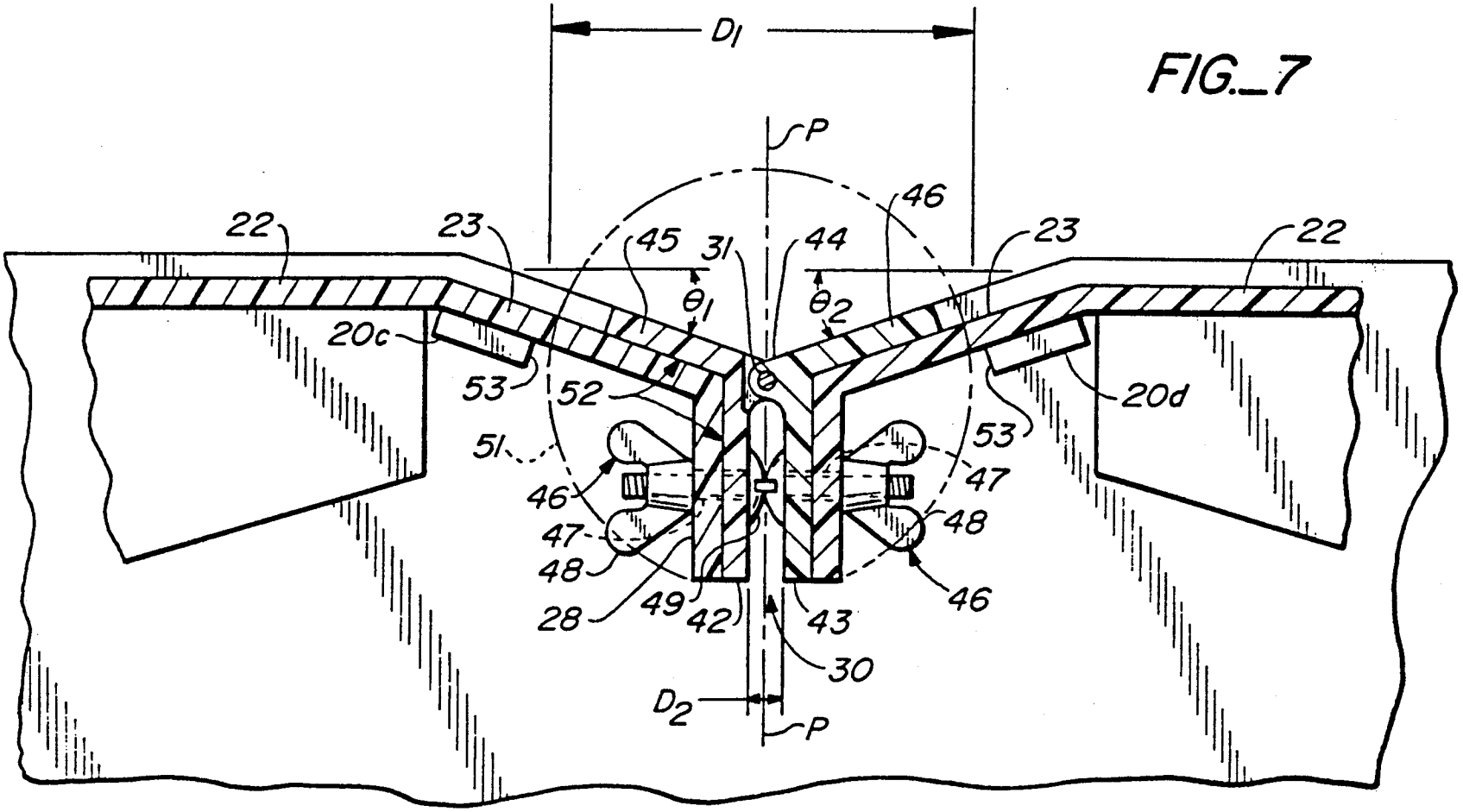
FIG. 7 is an enlarged detail of the spider hinge of FIG. 6.

FIG. 7 illustrates plastic spider hinge 30 of the invention in more detail.

The hinge 30 is segmented and includes a pair of legs 42, 43 and a pair of arms 45, 46 that project from a central spine 44. Each leg 42, 43 is vertical and off-set a horizontal distance D2 from the other. Each is also rectangular in cross section.

As a result, the roof segments 22, 23 of the front and back L-shaped panels can be attached via lips 28 to the legs 42, 43 by wing nut-bolt combinations 46. The combinations 46 are designed to enter through openings 47 within both lips 28 and legs 42, 43 of the hinge 30. After attachment via wing nuts 48, bolt head 49 is seen to rest in the cavity 50 formed between the legs 42, 43 below the spine 44 of the hinge 30.

In accordance with the invention, the orientation and design of the roof segments 22, 23 of the L-shaped front and back panels and the shape of the spider hinge 30, permit either of these panels to be separately swingable about pivot axis 31 coincident with working plane P. Yet these panels 13, 14 can also be strongly locked in a full open position, as desired.

Since the complementary cants of the arms 45, 46 of the hinge 30 are mirrored in the similar orientation of both the end roof segment 23 and of the support stops 20*a*–20*d*, this design aids the user to correctly position the front and back panels during operations. That is, the canted design of the invention permits the user to easily attain one of two positions: (i) a closed position wherein both pairs of stops 20*a*, 20*b* and 20*c*, 20*d* are used to support the front and back panels at four locations; and (ii) in an open position in which the lateral pairs 20*b*, 20*d* or 20*a*, 20*c* support both panels 13, 14 in a nested relationship.

In more detail in FIG. 7, the rotation outline of the hinge 30 is seen to be within annular space 51 positioned between stops 20*c*, 20*d*, yet does not intersect the plane of the latter. i.e., during rotation about the pivot axis 31 to an open position, both the attached lips 28 and legs 42 and 43 easily clear the stops 20*c*, 20*d* since the diameter of rotation space 51 is less than the distance D1 between the stops 20*c*, 20*d*.

Attachment between each of the arms 45, 46 and legs 42, 43 of the hinge 30 with the front and back panels is defined by a rectangle having a lateral dimension equal to the length of the hinge 30 and transverse dimension equal to the length of arms 45, 46 or the length of the legs 42, 43. Such attachment is generally indicated at 52 and is seen to be associated with one of the following: (i) arms 45, 46 atop the canted end-roof segment 23 and (ii) legs 42, 43 in contact with lips 28. As to item (i), above, note also that such surface contact 52 is canted to the same degree as the cant of end-roof segment 23 and thus forms a firm anchor should it be stationary during rotation of the other panel from an original stable position (say FULL CLOSED-TO-OPEN or vice versa) to a new stable position. As to item (ii), above, the length of each leg 42, 43 and the lip 28 is less than the distance Di between the support stops 20*c*, 20*d*. The distance D1 is measured between near terminating edges 53 (relative to the working plane P) of the support stops 20*c*, 20*d*. When one of the panels is rotated about the pivot axis 31, the annular space 51 defines the edge of the pathway of rotation of the surface contact 52 between the leg 42 or 43 and lip 28 of the rotating panel. As previously mentioned, the pathway of rotation is seen to be clear from contact with and passes freely between the stops 20*c*–20*d*.

In FIG. 7, the canted stops 20*c*, 20*d* are also seen to define complementary skew angles $\theta 1$ and $\theta 2$ where $\theta 2$ is equal to 180-$\theta 1$, relative to a horizontal normal to the working plane P. Such angles $\theta 1$ and $\theta 2$ are each between 20 and 30 degrees. Hence the rotation angle is equal to 180-2($\theta 1$).

Likewise, the arms 45, 46 of the hinge 30 are oppositely canted relative to each other in opposite complementary directions when the front and back panels 11, 12 are in closed positions. These complementary directions follow the contour of the end roof segments 23 as previously explained, and likewise are defined by the complementary skew angles $\theta 1$ and $\theta 2$ previously discussed.

Returning to FIG. 7, after the lips 28 of the end-roof segment 23 has been attached via wing nut-bolt combinations 46 to the hinge 30 in the closed positions, the unstressed position of the hinge 30 is attained. The hinge 30 is stressed when either of the panels 13 or 14 is rotated relative to pivot axis 31. But the hinge 30 has sufficient rigidity to keep the panels 13, 14 in correct working position. That is, the thickness of the spine 44 is sufficient to prevent collapse at the axis 31 during and after rotation.

METHOD ASPECTS

Assembly at the use site includes positioning elements of the hinge 30 in close proximity of the lips 42, 43 of the L-shaped panels 11, 12. Then these elements are attached using wing nuts 48 of the nut-bolt combinations 46. These wing nuts 48 are tightened relative to bolt head 49 by hand pressure. The front and back panels 13, 14 with hinge 30 attached are next placed in contact with the stops 20*a*–20*d* of the side panels 11, 12 to complete assembly. Disassembly is the reverse of the above steps. All such steps also occur without the need for tools.

Having described a method and apparatus in accordance with the invention in which advantages can be appreciated by those skilled in the art, it also is evident that certain variations are suggested. It is therefore my intent that such variations be within the scope of the invention as set forth in the following claims.

What is claimed is:

1. A food cover for providing stable closed and open positions relative to a horizontal base, comprising (i) a pair of upright side panels resting upon a substantially horizontal base, each of said side panels having a pair of oppositely canted, integral support stops positioned about a working plane substantially normal to both said pair of side panels and said horizontal base, (ii) a pair of L-shaped front and back panels each having a side wall segment and a roof segment, said roof segment terminating in a canted end-roof segment and a lip positioned adjacent to said working plane, (iii) a hinge means having a pivot axis coincident with said working plane, said hinge means being segmented into a plurality of arms and legs radiating from a central spine segment also coincident with said pivot axis, (iv) hand tightened attaching means for separately but disconnectably connecting said lip of each of said front and back panels relative to said hinge means in an easy assembly/diassembly relationship yet after connection with said lip, permitting surprisingly stable rotation about said pivot axis of an associated L-shaped panel relative to the other, from an original stable position to a new stable position (CLOSED-TO-OPEN or OPEN-TO-CLOSED) relative to said horizontal base.

2. The food cover of claim 1 in which said integral support stops of said pair of upright side panels includes lateral pairs of like canted stops positioned in coplanar relationship across said food cover, and in which said canted end-roof segment of said other L-shaped panel rests atop and is supported upon said lateral pair of like canted support stops during movement of said associated L-shaped panel from said original stable position to said new stable position.

3. The food cover of claim 2 in which said plurality of arms and legs includes broad surfaces in surface contact with one of (i) said canted end-roof segments of said front and back panels and (ii) said lips of said front and back panels.

4. The food cover of claim 3 wherein said broad surfaces of legs of said hinge are in surface contact with said lips of said front and rear panels, and in which each of said broad surfaces is of a length that is less than half the horizontal distance measured between terminating edges of said lateral pair of canted support stops so that when said associated L-shaped panel is rotated about said pivot axis, a pathway defined by rotation of said each of said broad surfaces is clear from contact with and passes freely between said lateral pair of stops.

5. The food cover of claim 3 wherein said broad surfaces of arms of said hinge are in surface contact with said canted end-roof segments of said L-shaped panels and in which each of said broad surfaces is likewise canted with respect to said canted end-roof segments and remains in contact therewith during rotation of said associated L-shaped panel relative to said other L-shaped panel from original stable position to said new stable position.

6. The food cover of claim 2 in which said pairs of lateral stops can be re-grouped into first and second pairs of non-lateral, oppositely canted stops, of said side panels wherein each of said re-grouped first and second pairs include first and second stops that define complementary skew angles $\theta 1$ and $180-\theta 1$ relative to a horizontal normal to said working plane.

7. The food cover of claim 6 in which $\theta 1$ is between 20 and 30 degrees.

8. The food cover of claim 2 in which said closed stable position is achieved when said side wall segment of both said L-shaped panels rests in contact with said horizontal base, and in which said open stable position is achieved by rotation of one of said front and back panels in a rotational direction away from said horizontal base until surface contact between said canted end-roof segments of both said L-shaped panels occurs.

9. The food cover of claim 8 in which said closed position is further characterized by said canted end-roof segments of said L-shaped front and back panels being complementary canted relative to said working plane thereby defining complementary skew angles $\theta 1$ and $180-\theta 1$ relative to a horizontal normal to said working plane.

10. The food cover of claim 9 in which total rotation is equal to 180-2 X skew angle $\theta 1$.

11. The food cover of claim 9 in which $\theta 1$ is between 20 and 30 degrees.

12. The food cover of claim 1 in which said pivot axis of said hinge is substantially parallel to said horizontal base supporting said side panels and normal to said side panels.

* * * * *